United States Patent [19]

Geffe

[11] 4,228,631

[45] Oct. 21, 1980

[54] HOLLOW RECTANGULAR JOIST

[76] Inventor: Bruce T. Geffe, 18517 NE. 20th Pl., Redmond, Wash. 98052

[21] Appl. No.: 941,552

[22] Filed: Sep. 12, 1978

[51] Int. Cl.[3] ..... E04C 3/08; E04C 3/16

[52] U.S. Cl. ..... 52/690; 52/634; 52/693; 52/731

[58] Field of Search ..... 144/314 B, 315 R, 318, 144/319; 52/634, 690–692, 730, 731, 693

[56] References Cited

U.S. PATENT DOCUMENTS

| | | | |
|---|---|---|---|
| 1,644,940 | 10/1927 | Moyer | 52/634 X |
| 2,941,635 | 6/1960 | Harris | 52/634 |
| 3,263,387 | 8/1966 | Simpson | 52/634 |
| 3,345,792 | 10/1967 | Chandler | 52/648 |
| 3,651,612 | 3/1972 | Schmitt | 52/642 |
| 3,702,050 | 11/1972 | Price | 52/693 |
| 3,861,109 | 1/1975 | Hunt et al. | 52/693 |
| 4,001,999 | 1/1977 | Chandler | 52/693 |
| 4,074,498 | 2/1978 | Keller et al. | 52/690 |

FOREIGN PATENT DOCUMENTS

| | | | |
|---|---|---|---|
| 885707 | 11/1971 | Canada | 52/690 |
| 957821 | 11/1974 | Canada | 52/690 |
| 2242329 | 3/1974 | Fed. Rep. of Germany | 52/690 |
| 896984 | 5/1962 | United Kingdom | 52/730 |

*Primary Examiner*—Alfred C. Perham
*Attorney, Agent, or Firm*—Ford E. Smith; David L. Garrison

[57] ABSTRACT

A wooden structural member or joist having a continuous tension chord and a continuous compression chord which are spaced apart and parallel. The tension chord and compression chord form the effective top and bottom of the joist, the actual orientation depending on the type of load imposed upon the joist. Dentations or dentated panels connect the side edges of the tension chord to the side edges of the compression chord, thus forming the two sides of the joist which has a hollow rectangular cross sectional shape. The dentations are planar with two parallel edges and two non-parallel edges tapering together forming a broad end and a narrow end. The face of the broad end is glued to the side edge of the compression chord, and the face of the narrow end is glued to the side edge of the tension chord. The sides of the joist are discontinuous because of the dentated shape. The dentations are coordinately spaced to allow pipes, conduits, ducts and other equipment to pass transversely through the joist. The hollow rectangular shape also allows such equipment to pass longitudinally along the joist between the ends.

8 Claims, 12 Drawing Figures

HOLLOW RECTANGULAR JOIST

BACKGROUND OF THE INVENTION

The field of this invention is building materials, particularly wooden beams, trusses, joists and girders. The current invention is intended to be used primarily in residential or light commercial construction and other applications where a wooden joist is appropriate.

Increasing costs of lumber and potential lumber shortages have precipitated the need for increased efficiency in the design and use of wooden beams, trusses, joists and girders. Wooden trusses have been used extensively. Chandler discloses a wood truss structure in U.S. Pat. No. 4,001,999, and a wood deck structure utilizing a wood truss in U.S. Pat. No. 3,345,792. Hunt et al. discloses a continuous shear resistant timber girder in U.S. Pat. No. 3,861,109 which uses a truss design including some attached side panels. Price uses a lattice web in his wood truss shown in U.S. Pat. No. 3,702,050. Snider uses discontinuous side panels in his wooden joist shown web glued to the flanges in U.S. Pat. No. 4,074,498.

Construction of steel beams has been made more efficient by cutting an I-beam web along a serrated line and fabricating the beam by welding along the points of the serrations. This is demonstrated by Moyer in U.S. Pat. No. 1,644,940. A fabricated non-symmetrical steel beam is shown by Simpson in U.S. Pat. No. 3,263,387. Harris describes a hollow rectangular sectional metal beam using discontinuous rectangular panel sidewalls in U.S. Pat. No. 2,941,635.

The prior art has problems in several respects. Prior wood truss devices have an overall depth so great in many cases they require an increase to the height of the structure. This in turn increases building costs associated with the increased height which offset or exceed the savings associated with the truss. This problem is especially applicable to floor joists in most light construction. Wood trusses are difficult and relatively costly to fabricate in many instances unless the time and costs associated with a shop production layout are incurred. Special jigs or patterns may be necessary to aid in the cutting, fitting and connecting of truss components. The prior art has also not appropriately optimized the amount of glue surface area required between the tension and compression chords and the truss members. Wooden beams cannot be fabriated by gluing the points of serrated or dentated core halves together because of insufficient glue area. The prior art has also failed to develop optimum means for dissipating the effects of concentrated stresses at the support points in wooden beams. True box type wooden beams heretofore disclosed do not provide usable spaces for running transverse conduit at any point along the entire length of the beam. Staggered placement of the side panel elements has prevented convenient location of transverse runs of conduit or other utility ducts. True box beams also use side panels which are continuous for the length of the beam, requiring excessive amounts of material. Current wooden box beams do not allow passage of conduit, pipes, wires, etc. along the length of the beam because of the occasional placement of vertical spacers. Box beams incorporating relatively large distances between adjacent side panels at one point so that transverse conduits may pass through the opening have reduced strength to resist lateral loading.

SUMMARY OF THE INVENTION

One object of this invention is to provide a wooden joist which requires less wood than solid joists while being relatively inexpensive and easy to make from readily available building materials without the extensive production facilities. It is a further object of this invention that the joist allow pipes, heating ducts, conduits and similar equipment to pass transversely and longitudinally through the joist thus eliminating the need for a dropped ceiling. Another object of this invention that the joists be strong enough to allow spacing at greater centerline-to-centerline distances and also greater clear space capabilities than the conventional solid joists while providing increased resistance to beam deflection.

The invention comprises an elongated tension chord and elongated compression chord in a parallel spaced apart orientation, the chords being connected by a series of dentations or dentated panels or a combination of dentations and dentated panels. The dentations are planar with a broad end and a narrow end. The face of the broad end is glued to a side edge of one of the chords. The face of the narrow end is glued to a side edge of the other chord. Having a sufficient glue area at these dentation-to-chord connections is a critical feature which has been optimized by the current invention. The dentations may also be attached to the tension and compression chords by using nails, screws or other fasteners. Dentations are disposed along both side edges of the tension and compression chords so that they form a joist having a hollow rectangular cross sectional shape with discontinuous sides. The dentations may be spaced at varying distances along the joist or abutting one another. The tension chord is reinforced at each end by an end reinforcement located parallel to and in contact with the tension chord between the tension and compression chords. The end reinforcements extend inwardly from the end of the tension chord for a distance dictated by load requirements. Generally the side edges of the end reinforcement contact at least two dentations. A spacer extends between the compression chord and end reinforcement at each end of the joist to properly space and reinforce the support end portions of the joist. The beam can be supported from either the tension chord or the compression chord.

The joist can be used anywhere a solid wood joist would normally be used, for either roofs, floors or both, in a home, commercial building or apartment construction. The joist may also be used in other applications where a wood or steel beam having equivalent strength is used. The joist is oriented with respect to the load so that the one chord member receives compressive forces and the other chord member receives tension forces. Where there is a single concentrated load applied to the beam, additional reinforcement or varying dentation panel designs may be necessary to optimally distribute the load. The joist can also be constructed with a predetermined camber to compensate for flexing of the joist under its load where the application so requires.

The current invention provides several advantages over the prior art the first of which is a relatively low profile compared to prior wood truss devices thus decreasing the overall structure height. The openness of this joist also greatly reduces the amount of solid wood necessary to support an equivalent load. The dentated side panel design reduces the materials necessary for side panels by almost one half, compared to the true box beams. The current invention can be constructed without metallic fasteners or gusset plates since the chord-to-side panel connection may be formed exclusively by adhesives. The joist can also be economically constructed with nominal setup or layout costs with readily available building materials such as nominal two inch by four inch lumber for the chords and structural grade plywood for the dentations. This simplified wooden construction substantially reduces labor costs. The hollow rectangular cross-sectional shape generally will evidence, it is believed, greater strength against lateral loads than equivalent wood I-beams. The beam has the definite advantage of allowing conduit, pipes and other equipment to be run both transversely and longitudinally through the beam.

The joist of this invention may be assembled using any of the well known glue systems. Preferrably a rapid curing glue such as a resorcinol phenol resin glue which may be cured by the use of radio frequency energy is the most desirable glue for usage herein to optimize production.

DESCRIPTION OF THE PREFERRED EMBODIMENT

Figures 1, 2, 3, 4, 5, 6:
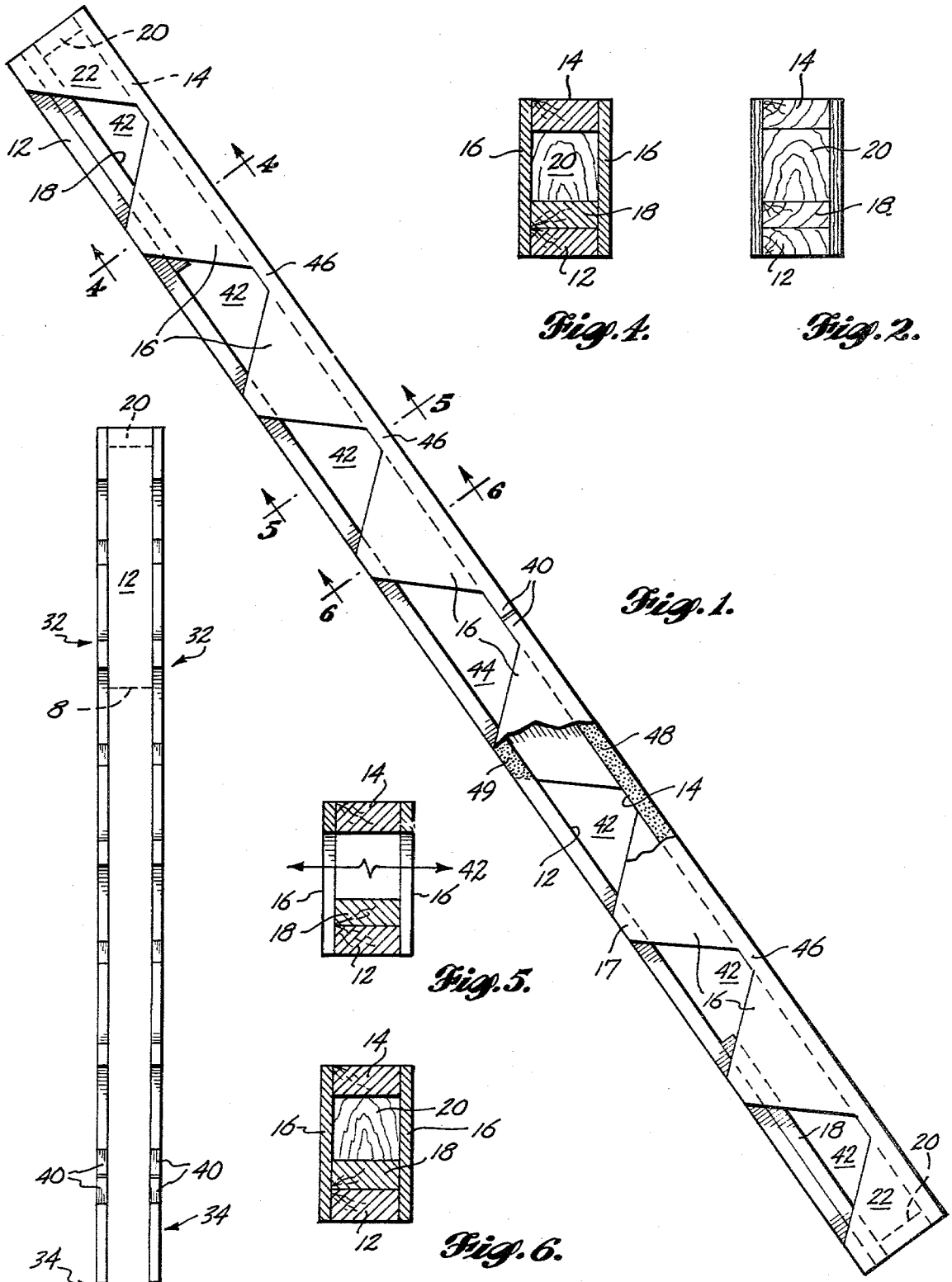
FIG. 1 is a side view of one embodiment of the non-symmetrical joist of this invention with portions broken away for convenience of illustration.
FIG. 2 is an end view of the joist shown in FIG. 1 with the compression chord at top and the tension chord and end reinforcement at the bottom.
FIG. 3 shows a partial bottom view of the joist shown in FIG. 1.
FIG. 4 is a cross-sectional view of the joist taken at line 4—4 of FIG. 1.
FIG. 5 is a cross-sectional view of the joist taken at line 5—5 of FIG. 1.
FIG. 6 is a cross-sectional view of the joist taken at line 6—6 of FIG. 1.
Figure 10:
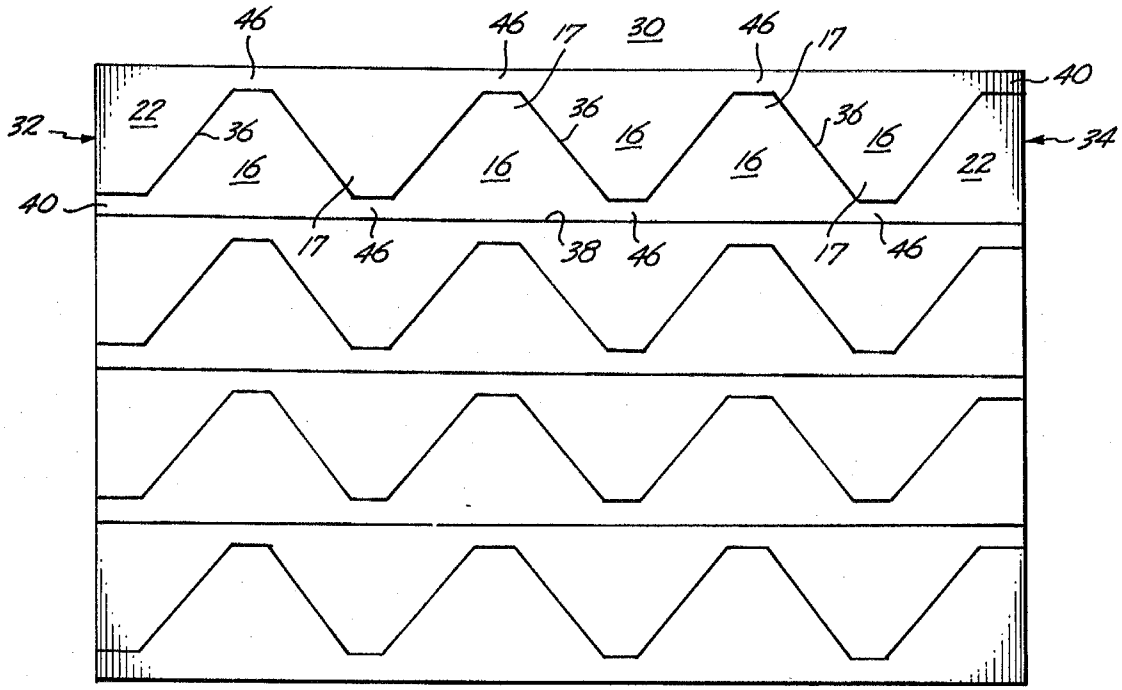
FIG. 10 shows a plan view of a rectangular panel marked for sawing or otherwise severing so that eight interchangeable dentation panels are produced.

FIGS. 1–8 show a preferred form of the invention as embodied in a joist comprising tension chord 12, compression chord 14, and in opposed relation on each side, two series of vertically disposed dentations 16. End reinforcements 18 and vertical spacers 20 are normally employed in the preferred joist form. As shown in FIG. 1 the end dentations 22 are about one-half the size of dentations 16. The dentations 16 and 22 of the joist shown in FIG. 1 are produced as shown in FIG. 10 from a plywood or other reconstituted structural grade wooden panel, shown generally at 30. The panel is laid out in four parallel units about 12 inches wide, each of which is subdivided into an interfitted pair of elongated dentated panels 32, 34. In this form of construction the dentations 16 and 22 of panels 32, 34 are cut apart along the line 36 and from the other pairs by cutting along line 38. The dentated panels 32 and 34 are shown as used in FIG. 1 in tandem with end dentations 22 placed at the ends of the joist and the tongues or tabs 40, abutting in the mid portion of the joist. Of course, if different dimension beams are being produced, different size, smaller or larger, dentated panels will be used.

It is to be noted that dentated panels 32,34 are placed on both edges of the support and spaced apart chords 14 and 12 in alignment. This arrangement provides passages 42 and 44 through the beam to permit various forms of conduit as for electrical service, water, heating and ventilation purposes to be passed both transversely and longitudinally through the joists.

Figures 7, 8, 9:
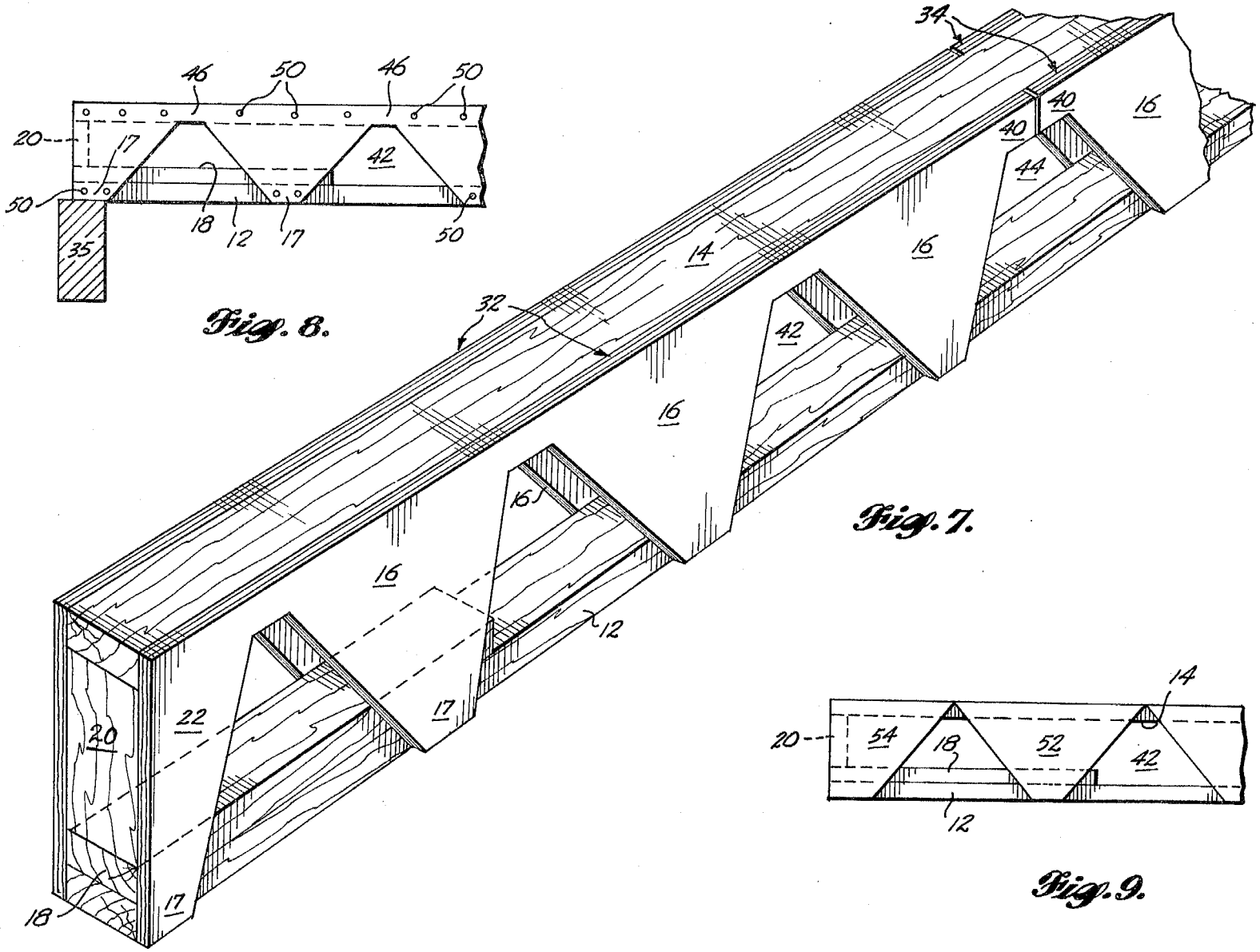
FIG. 7 is a partial isometric view of an end portion of the joist shown in FIG. 1.
FIG. 8 shows the use of the mechanical fasteners to preliminary attach the dentated panels to the compression and tension chords.
FIG. 9 shows an alternative embodiment of the invention.

In the dentated panels 32 and 34, the various dentations 16 of the series are joined by bridge portions 46 as can be seen in both FIG. 1 and 10. When the joist is being assembled, bridge portions 46 are placed against the edges of compression chord 14 and they are secured by an interposed layer of adhesive 48, preferably a waterproof polymeric resin adhesive such as a resorcinol phenol resin. In similar fashion, the blunt ends 17 of the tapered dentations 16 and 20 are adhesively joined at 49 to the edges of the tension chord 12. In the preferred practice of producing joists as shown and described in FIG. 1, the parts are assembled and securely clamped together for a time permitting the adhesive to set. Under such circumstances no fasteners are required. Absent the availability of suitable clamping equipment, the joist may be assembled as shown in FIG. 8 wherein the glue joints are secured together temporarily by fasteners 50 which may be nails or screws. When the adhesive bonds have developed, the strength of the joist will depend predominantly upon the glue joint.

In FIG. 9 an alternative construction is shown in which the dentations 52,54 are individual, truncated triangular shaped elements as contrasted with the dentated panels 32,34 previously described. Preferably dentations 52 and 54 in aligned opposite pairs are joined to the chords 12 and 14 by an adhesive as described above for the embodiment shown in FIGS. 1–8.

Figure 11:
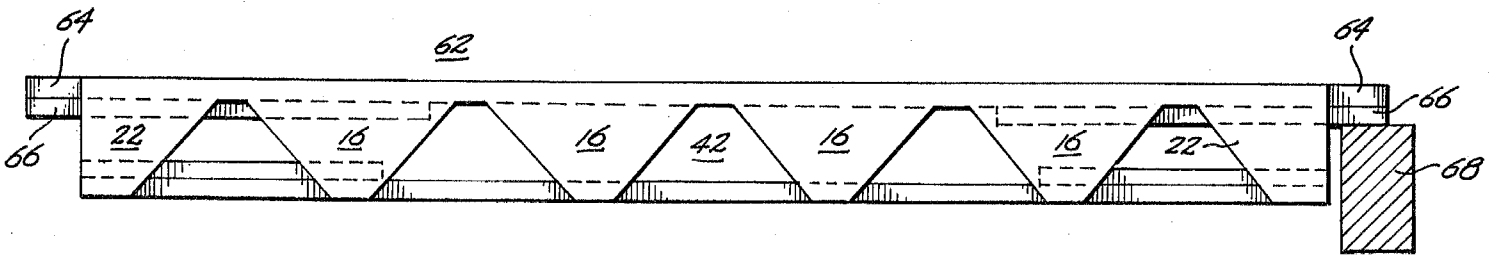
FIG. 11 shows a further alternative embodiment in which the joist is supported upon the ends of the compression chord.

In FIG. 11 is illustrated a joist construction 62 for installation in a mode somewhat at variance with an installation of joists as shown in FIGS. 1–8. In this case the compression chord 64 has been extended and provided with end reinforcements 66 to form protrusions by which the joist may be hung at its end from a transverse support means 68. This distinguishes from the mode of installation of FIG. 1 joist which is installed so that the ends of the tension chord 12 rests on transverse beams 35 as suggested in FIG. 8.

Figure 12:
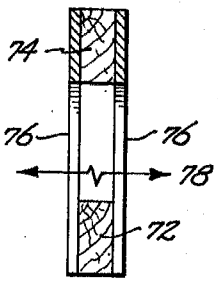
FIG. 12 is a cross-section of a third embodiment of the joist according to this invention.

A further variation is illustrated in FIG. 12. In this instance the chordal members, being about twice as wide as they are thick, are disposed on edge. The tension chord 72 and the compression 74 are joined in spaced apart relation by opposed dentation panels 76,76. Advantages in this variation are greater contacting glue surfaces and greater stiffness in the joist. In some cases the height of the joist may be somewhat greater if the pass through passages 78 are kept to size comparable to passages 42 of FIG. 1 joist.

Usually the dentation panels 32,34 are cut from sheets of plywood in thickneses of $\frac{1}{4}$ inch to $\frac{3}{4}$ inch or thicker as various strengths are specified. The chordal members are preferably dimension lumber, such as lumber commonly known as two-by-fours which today have actual dimensions of about 1½ inches by 3½ inches. This joist construction also allows for the use of fabricated chordal members in which numerous pieces are finger-jointed or spliced together at their ends. The full length gluing of the dentation panels along the length of compression chord 14 effectively increases the thickness, hence the strength of chords 14. End reinforcements 18 provide greater gluing surfaces and strengthen the glue joints of dentation 16 and 22 to the tension chord, thus very effectively increasing the overall joist strength and ruggedness at the load bearing points indicated by arrows in FIG. 1.

The structural members or joists described above are manufactured by a method wherein a minimum of waste of the raw materials utilized occurs. Initially a pair of elongated substantially rectangular end reinforcement are connected to an elongated substantially rectangular tension chord in face-to-face orientation. The tension chord is preferably a nominal two-by-four inch dimension lumber. Both end reinforcement elements are connected to the same face of the tension chord, one being positioned at each end of the tension chord and extending inwardly. Preferably the joint between the end reinforcement elements and the tension chord will be formed by a suitable glue joint. An elongated substantially rectangular compression chord is then positioned approximately parallel to and in spaced apart relationship to the tension chord and end reinforcement elements. Spacers are employed spanning the distance between the compression chord and the tension chord so that one spanner element is connected at each end of the compression chord and end reinforcement combination and to the tension chord. This configuration results in the tension chord and compression chord lying in a substantially parallel relationship but spaced apart a distance dictated by the ultimate dimensions of the structural member being formed.

A rectangular sheet of wood, such as plywood or other reconstituted wood panel, is then partitioned into interchangeable dentated panels by severing the sheet along a single dentated partitioning line to form two interchangeable panels without wasteage of the material. In FIG. 10 a suitable pattern for partitioning the rectangular sheet of wood is shown. The cuts along lines 38 are made to sever the sheet into four sections. The four sections are then cut along a zigzag line 36 which forms a series of toothlike projections or dentations. One of the two dentated panels thus formed may be inverted and rotated 180° so that identical panels are formed. Each of the dentated panels may be described as having an interior face **16*a* and exterior face 16*b*, a continuous approximately straight compression edge 33, a continuous approximately straight end edge 35, substantially perpendicular to the compression edge, an approximately straight interior edge 37, also substantially perpendicular to the compression edge and a discontinuous approximately straight tension edge 39, substantially parallel to the compression edge and perpendicular to the end edge. The dentated panels can be further described as having a series of truncated isosceles triangles removed from the tension edge 39** formed by severing the sheet along the aforementioned dentated partitioning line.

Referring specifically to FIGS. 7 and 10, it will be seen that four of the dentated panels are utilized in preparing the structural joist-like member shown. Each of the dentated panels is positioned with its end edge 35 at the end 41 of compression chord 14 and with compression edge 33 co-planar with the outer surface of compression chord 14. In this manner the dentations project downwardly as shown in FIG. 7 and the discontinuous tension edge 39 engages the sides of tension chord 12. Glue joints or other suitable fastening means are utilized to attach the panels 16 to the chord members 14 and 12 as well as to the above noted end reinforcement 18 and vertical spacers 20.

Thus, by the method of this invention, it is possible to manufacture a surprisingly strong joist member of any length from two dimension lumber pieces of a nominal size of two inches by four inches and a sheet of plywood having the dimension of two feet by eight feet without wasteage of any material.

In some installations the joist may be installed in an overturned aspect whereupon the chord functions are reversed and a substantial tension loading is imposed upon the lowermost member.

It will be noted that the joist as disclosed herien may be used at center-rto-center spacings greater than customary with solid wooden joists and in greater spans than have been customary for joists of comparable dimensions.

While the invention has been described in detail with reference to the appended drawings, it is to be understood that changes and variations may be made without departing from the spirit and scope of the invention as set forth in the appended claims.

What is claimed is:

1. A structural wooden joist-like member comprising:

(a) an elongated substantially rectangular tension chord;

(b) an elongated substantially rectangular compression chord in a spaced apart generally parallel opposed relation to said tension chord;

(c) a pair of elongated side members each including a number of planar dentations connecting both side edges of the tension chord to the respective side edges of the compression chord, said dentations each having two non-parallel side edges resulting in each dentation having a broad end and a narrow end; said dentations being serially connected to provide a planar face connected with the side edge of the compression chord and thereby materially increasing its transverse cross-section; the narrow ends of the said dentations being connected with the side edge of the tension chord; and the connections of said dentated side members to the tension and compression chords creating a joist having a substantially hollow rectangular cross-sectional shape in which the compression chord has a greater cross-section than the tension chord; the said dentations forming one side of the said hollow joist being coordinately disposed with dentations forming the opposite side of the joist providing through passages permitting wiring, pipes, conduit, ducts or other apparatus to extend transversely through the resulting joist openings;

(d) end reinforcements connected face-to-face with said tension chord at each end thereof; said end reinforcements being between the tension chord and the compression chord; said end reinforcements being at each end of the joist extending inward from the end of the joist so that each side edge of each end reinforcement is connected to the said connected planar face of at least two of the dentations; and (e) upright spacers at each end of the joist, said spacers being connected to the adjoining faces of the said compression chord, said end reinforcements, and planar faces of both dentations located at the joist ends on opposite sides of the joist.

2. The invention of claim 1 wherein the dentations are spaced together so that a portion of the non-parallel side edges of the broad end of the dentations are in contact with at least a portion of any adjoining non-parallel side edges of the broad end of the adjacent dentation(s).

3. The invention of claim 1 wherein the joist is constructed entirely of wood.

4. The invention of claim 1 wherein said tension chord, compression chord, end reinforcements and vertical spacers are made from 2 inch by 4 inch nominal sized lumber, and said dentations are made from plywood.

5. The invention of claim 1 having said connections effected by an interposed adhesive.

6. The invention of claim 4 having all of said connections effected by an interposed adhesive film.

7. The invention of claim 5 having at least one of said connections effected by the use of mechanical fasteners.

8. The invention of claim 6 having at least one of said connections effected by the use of mechanical fasteners.

* * * * *